United States Patent [19]

Stobb

[11] Patent Number: 4,496,140

[45] Date of Patent: Jan. 29, 1985

[54] APPARATUS FOR HANDLING A SIGNATURE

[75] Inventor: Walter J. Stobb, Pittstown, N.J.

[73] Assignee: Stobb, Inc., Clinton, N.J.

[21] Appl. No.: 533,302

[22] Filed: Sep. 19, 1983

[51] Int. Cl.[3] ..... B65H 39/02

[52] U.S. Cl. ..... 270/54; 83/925 A

[58] Field of Search ..... 270/54, 60, 58, 21.1; 83/925 A, 268, 856, 29, 151, 154, 404, 404.1, 404.3, 420, 753

[56] References Cited

U.S. PATENT DOCUMENTS

| | | | |
|---|---|---|---|
| 1,637,170 | 7/1927 | Zuckerman . | |
| 2,874,775 | 2/1959 | Muller | 83/925 A |
| 3,064,512 | 11/1962 | Zurlo | 83/925 A |
| 3,167,987 | 2/1965 | McCain | 83/925 A |
| 3,528,332 | 9/1970 | Thumim et al. | 83/925 A |
| 3,570,344 | 3/1971 | Bryson et al. | 83/925 A |
| 3,570,350 | 3/1971 | Fogg | 83/925 A |
| 3,888,150 | 6/1975 | Stroud et al. | 83/925 A |
| 4,046,366 | 9/1977 | McCain et al. | 270/54 |
| 4,060,231 | 11/1977 | Stobb et al. | 271/80 |
| 4,164,159 | 8/1979 | Marciniak | 83/268 |
| 4,203,334 | 5/1980 | Zettler | 83/29 |
| 4,312,255 | 1/1982 | Holmstrom | 83/856 X |

FOREIGN PATENT DOCUMENTS

| | | | |
|---|---|---|---|
| 2430043 | 1/1975 | Fed. Rep. of Germany | 83/925 A |

*Primary Examiner*—E. H. Eickholt

*Attorney, Agent, or Firm*—Arthur J. Hansmann

[57] ABSTRACT

Method and apparatus of handling signatures which are first presented to a rotating type of trimmer and are then collected in a compensated stack where the folds of the signature are positioned on opposite sides for levelling the stack. The trimmer includes a clamp which secures the signature while it is being trimmed on its three open edges, and the clamp can then be actuated to move the signature to a collection location where the compensated stack of signatures is formed.

9 Claims, 5 Drawing Figures

APPARATUS FOR HANDLING A SIGNATURE

This invention relates to a method and an apparatus for handling a signature, and, more particularly, it relates to trimming the edges of a folded signature and passing the signature into a stack in a compensated manner

BACKGROUND OF THE INVENTION

Printed and folded sheets, in signature form, commonly require a final trimming of the edges. That is, the folded signature commonly requires that its free unfolded edges be trimmed. The trimming operation can require that the signatures be specially handled to be moved to a trimmer.

The present invention provides for an automated type of signature handling for trimming the edges of the signature and for subsequently stacking the trimmed signature in a compensated stack, such that the folds in the signature are on opposite sides of the final stack to thereby have a level stack of signatures. In accomplishing this objective, the signature can be virtually continuously moved into a trimmer and then into its compensated stack position, and thus a high-speed but yet accurate procedure is achieved.

More specifically, the present invention provides apparatus and method for handling signatures which can be trimmed by a rotation process, and thus the signatures can be continuously moved along a line of progression to their final stacked orientation. This arrangement provides for a high productivity in a given amount of time, and it also provides for a clean and accurate cut or trim to the signature and the compensated stacking of the trimmed signature.

DETAILED DESCRIPTION OF THE METHOD AND APPARATUS

Figure 1:
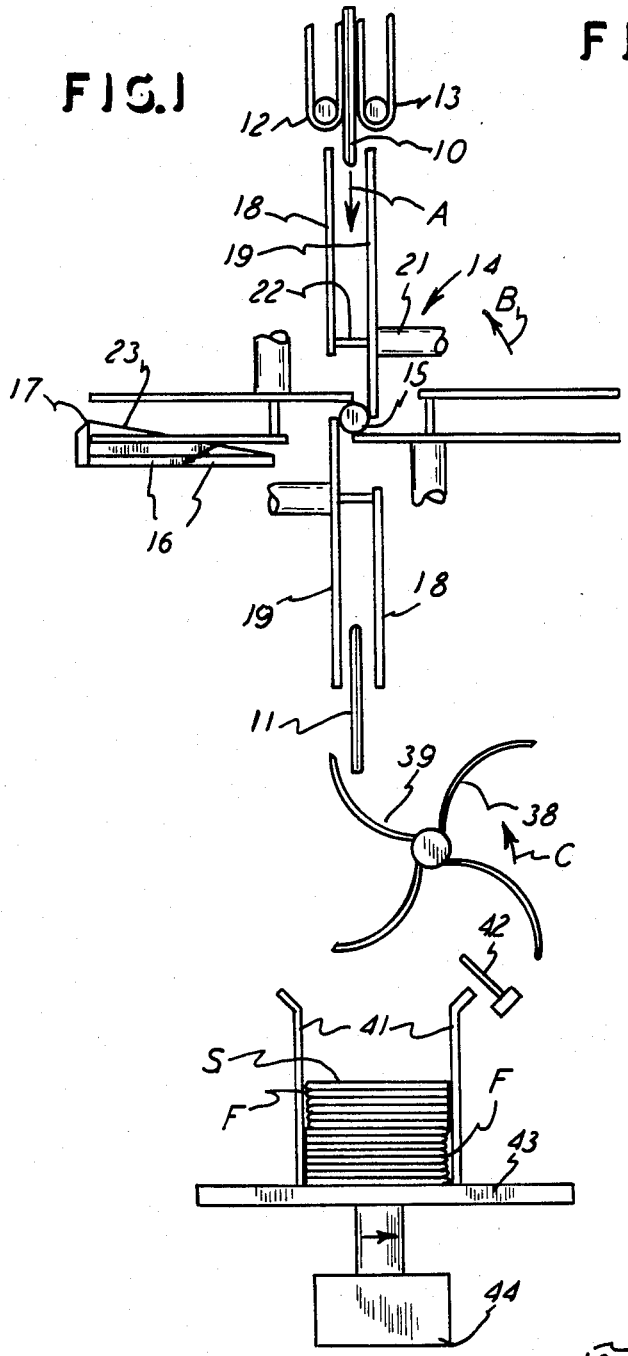
FIG. 1 is an end elevational view of an embodiment of apparatus of this invention.

In describing the apparatus shown in the drawings, the method invention herein will also be disclosed. Thus, the basic concept is to handle a folded sheet, that is a signature 10, and trim its edges and then pass the signature 10, such as the position of the signature designated 11, to a compensated stack S of the signatures 10 and 11.

Delivery mechanism or conveyors 12 and 13 are shown to control the signature 10 and advance it in the direction of the arrow designated A. The signature 10 is thus advanced to a trimmer, generally designated 14, and two side cutters 16 and one end cutter 17 are operative on the signature 10 when it is in the trimmer 14 to thus trim the three edges of the signature, other than the one folded edge shown. The trimmer 14 is indicated to be rotatable on a shaft 15 and in the direction of the arrow designated B. Also, the trimmer 14 has a clamp comprised of the two side members 18 and 19 which flank the signature 10 so that the signature can be secured and held by the clamp members 18 and 19 when passed to the members 18 and 19 by the conveyors 12 and 13. That is, the members 18 and 19 are shown to be spaced apart, in an open position, and the signature 10 can then be dropped therebetween. Subsequently, the members 18 and 19 are moved toward each other and into a clamping position to securely hold the signature 10 therebetween.

The clamp mechanism is shown to consist of a pneumatic cylinder 21 mounted on the member 19 and having a cylinder rod 22 extending over to the member 18. Thus, fluid pressure in the cylinder 21 will extend and retract the cylinder rod 22 and thus move the clamp member 18 toward and away from the member 19. Of course the members 18 and 19 are clamped together after the signature 10 is deposited therebetween, and the trimmer 14 then rotates a quarter turn in the direction of the arrow B to move the signature 19 past the two side cutters 16 and the one end cutter 17, and thereby trim the three edges of the signature 10, if all three edges are to be trimmed. Finally, the trimmer 14 continues to rotate in the direction of the arrow B and moves the signature down to the position of the signature 11 where the clamp member is moved away from the member 19, by the fluid cylinder 21, and the signature 11 can then be released from the trimmer 14.

FIG. 1 shows that there are four such clamps with members 18 and 19, but there of course can be any number of clamps or only one clamp on the entire trimmer 14, as needed or desired. Also, the rotation of the trimmer 14 can either be a continuous and paced type of rotation, or it can stop at the position of receiving a signature and then continue to rotate until the signature is released, as mentioned.

Figure 2:
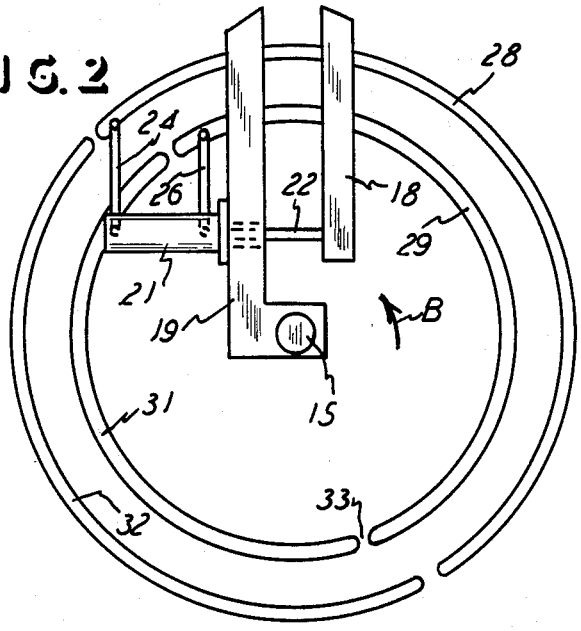
FIG. 2 is an end elevational view of the basic embodiment of a portion of FIG. 1, with parts added thereto.

FIG. 2 shows the shaft 15 and the detail of the members 18 and 19, and it will be seen that member 19 is affixed to the shaft 16, and the member 18 is connected with the member 19, such as through the rod 22 and through any other guide members extending therebetween but not shown but which of course would be apparent to one skilled in the art. Thus, the members 18 and 19 rotate in unison. Also, it will be understood that the trimmer 14 and the cutters described have relative movement, specifically rotation, therebetween, and thus the cutter edges 23 have relative movement with respect to the signature being trimmed, all so that a trimming or cutting action will occur. That is, anyone skilled in the art will understand that the cutters themselves could be rotated past the signatures, rather than the signatures being rotated to and past the cutters.

Further, the material trimmed from the signatures is adequately dispensed with, in any manner suitable but not shown in this instance.

The clamping action for the members 18 and 19 can be in various devices and mechanisms, and the one shown is a pneumatic powered one where the air cylinder 21 is shown mounted on the clamp member 19, and the cylinder 21 has its rod 22 suitably affixed to the clamp member 18, as mentioned. Air lines or passageways 24 and 26 connect with the opposite ends of the air cylinder 21 and are also in fluid flow communication with four air passageways in a stationary plate 27. Thus, there is an air-in passageway 28 in communication with the line 24, and it can be used for opening the clamp by extending the rod 22 while the air flows out the line 26 and out the passageway 29, if desired. Also, an air-in passageway 31 is on an arc to communicate with the rotating air line 26 and thus permit air to enter the cylinder 21 and retract the rod 22 to close the clamp by moving the member 18 toward the clamp member 19.

An air exhaust passageway 32 is in line with the line 24. The air passageways 28, 29, 31, and 32 are all on a circular pattern for communicating with the lines 24 and 26, as indicated in FIG. 2, and there are gaps or interruptions, such as at 33 between the ends of the passageways mentioned.

With that air flow arrangement, the rotation of the clamp and the flow communication between the air passageways and the air lines described will cause the clamp to close, such as when it is in the twelve o'clock position shown in FIG. 2, and it will cause the clamp to remain closed until it reaches approximately the six o'clock position in FIG. 2, at which time the clamp will release the signature 11 and permit it to fall to the collecting device described later.

Figure 3:
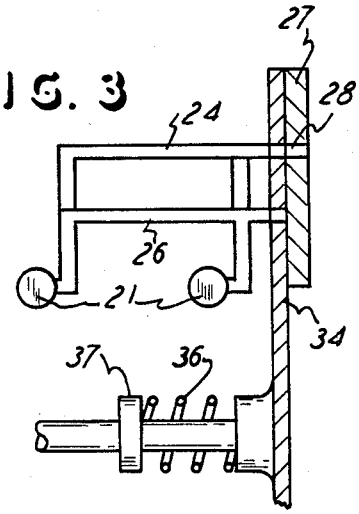
FIG. 3 is a side view of a portion of FIG. 2.

FIG. 3 shows the stationary air plate 27, and it shows a rotating plate 34 which carries the necessary air passageways for the cylinder actuation mentioned. A compression spring 36 forces on the plate 34 off a stationary stop 37 and thus positions the plate 34 into a fluid tight contact with the plate 37 when the plate 34 is rotating, for the purpose mentioned. Each clamp can be provided with two cylinders 21, as indicated in FIG. 3.

When the signature 11 is released by the clamp, it falls into a fan member 38 which rotates in the direction of the arrow designated C and it has the pockets 39 for receiving the falling signature and positioning it within the guides 41 where the signatures form the stack S, as shown. There can be a stripper member 42 adjacent the fan 38 to extend into the path of the signature on the fan 38, such as by projecting through a slot (unshown) in the blades of the fan 38. The stack S is formed on a rotating table 43 which can rotate one-hundred eighty degrees in either direction, such as under the influence of a motor 44, and thus the folded portion F of the signatures can be placed to opposite sides of the stack S to form the compensated stack for a level stacking. That is, the table 43 can be in one position while a few signatures are placed thereon with all of the folds to one side. Subsequently, the table 43 can be rotated one-hundred eighty degrees so that the next signatures placed in the stack S will have their folds on the other side of the stack, to accomplish the compensated stacking.

Figure 4:
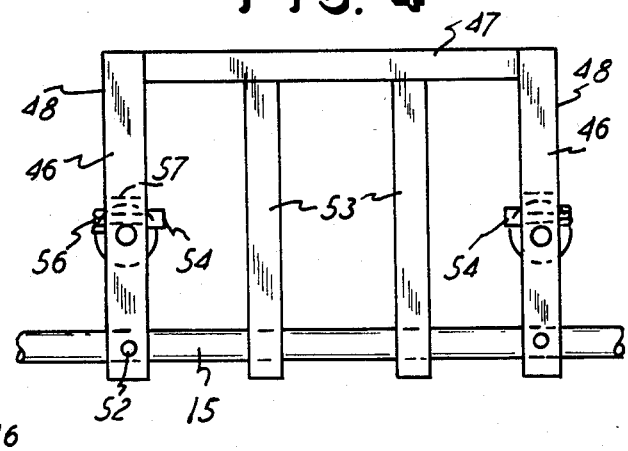
FIG. 4 is a side view of a portion of FIG. 2.
Figure 5:
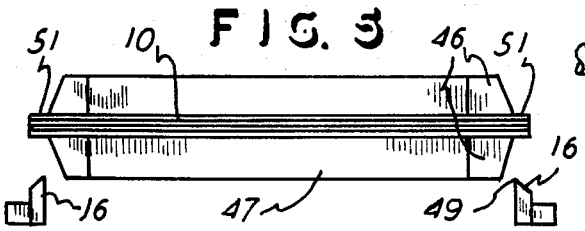
FIG. 5 is an end view of a portion of FIG. 4.

FIGS. 4 and 5 show arrangements of the clamp, and here it will be noticed that the shaft 15 has side bars 46 extending therefrom, in the nature and position of the members designated 19. A cross bar 47 is connected at the extending ends of the bars 46, and that determines the spacing between the outer edges 48 of the bars 46 and that spacing is the width of the signature after it is trimmed. When it is desired to change the width of the trimmed signature, then the cross member 47 is changed and a member of a different length can be inserted between the bars 46 and connected thereto, and that will change the spacing between the edges 48 and thus change the width of the signature to be trimmed, and of course it will be recognized that the side cutters 16 will also be adjusted to have their cutting edges 49 be in the plane of the edges 48 for trimming the signature overhang designated 51 in FIG. 5. That is, the bars 46 are adjustable along the shaft 15, and may be secured thereto by set screws 52, for instance.

The clamp members 18 and 19 also have intermediate support members or bars 53 which suitably attach between the shaft 15 and the end piece 47, for lending rigidity to the clamp and support to the signature therein.

The depth to which the signature can move into the clamp is determined by a stop 54 on the inside of each bar 46. The stops 54 are adjustable along the length of the bars 46 to adjust the depth to which the signature moves into the clamp, and to therefore adjust the amount of overhang of the edge of the signature beyond the member 47 and thereby determine the amount of trim on the signature by the knife 17. Thus, the opposite ends of the fold of the signature will abut the stops 54 for positioning the signature in the clamp and thereby determine the amount of end trim of the signature. An adjustment bolt 56 can be employed for adjusting the stops 54 within the slots 57 in the bars 46, for instance.

The formation of a compensated stack is shown in U.S. Pat. No. 4,060,231, with the use of apparatus different from that shown in this invention, but it does show two jaws or holding members spaced apart for receiving a signature therebetween and for depositing the signatures with their folds in opposite directions. Also, U.S. Pat. No. 1,637,170 shows the use of a fan member, and again a compensated stack could be formed thereby, and that requires two fans compared to that shown herein, and is different.

It will be seen that the arrangement is such that the holder or clamp member 19 is fixed with the shaft 15 to rotate therewith in the direction of the arrow B, and that rotation is such that the member 19 becomes a bed knife relative to the three cutting blades 16 and 17. Thus, the holder 18 is used for pressing the signature against the member 19 which then serves as the main member against which the cutting is accomplished.

What is claimed is:

1. Apparatus for handling a signature, comprising a conveyor for moving a signature and having a terminal end for releasing the signature, a rotatably mounted signature holder (movably) disposed adjacent said terminal end for receiving the signature from said conveyor and with an edge of the signature extending beyond said holder, a stationary cutter disposed adjacent said holder and in the path of movement of the extending edge of the signature for trimming the extending edge of the signature when the signature is rotationally moved past said cutter.

2. The apparatus for handling a signature as claimed in claim 1, wherein the signature has four edges with one thereof being folded and with said holder receiving the signature with the other three edges of the signature extending beyond said holder, and said cutter including three cutting edges with respective ones thereof in the path of movement of the other three edges of the signature, for trimming all three other edges off the signature when the signature is moved past said three cutting edges.

3. The apparatus for handling a signature as claimed in claim 2, including a rotatable receiver disposed adjacent said holder for receiving the signature from said holder and being rotatable in relation to the fold in the signature for forming a compensated stack of the signatures on the receiver.

4. The apparatus for handling a signature as claimed in claim 3, including a fan rotatably mounted intermediate said holder and said receiver for passing the signature therebetween and dropping the signature onto said receiver.

5. Apparatus for handling a signature, comprising a conveyor for moving a signature and having a terminal end for releasing the signature, a rotatably mounted signature holder disposed adjacent said terminal end for receiving the signature from said conveyor and with an edge of the signature extending beyond said holder, a stationary cutter disposed adjacent said holder and in the path of movement of the extending edge of the signature when the signature is rotationally moved past said cutter, and a rotatable receiver disposed adjacent said holder for receiving the signature from said holder and being rotatable in relation to the fold in the signature for forming a compensated stack of the signature on the receiver.

6. The apparatus for handling a signature as claimed in claim 5, including a fan rotatably mounted intermediate said holder and said receiver for passing the signature therebetween and dropping the signature onto said receiver.

7. Apparatus for handling a signature, comprising a conveyor for moving a signature and having a terminal end for releasing the signature, a signature holder movably disposed adjacent said terminal end for receiving the signature from said conveyor and with an edge of the signature extending beyond said holder, a cutter disposed adjacent said holder and in the path of movement of the extending edge of the signature for trimming the extending edge of the signature when the signature is moved past said cutter, a receiver disposed adjacent said holder for receiving the signature from said holder, and a fan rotatably mounted intermediate said holder and said receiver for passing the signature therebetween and dropping the signature onto said receiver.

8. Apparatus for trimming a signature, comprising a conveyor for moving a signature and having a terminal end for releasing the signature, a signature holder disposed adjacent said terminal end for receiving the signature from said conveyor and with an edge of the signature extending beyond said holder, a cutter disposed adjacent said holder and in the plane of the extending edge of the signature for trimming the extending edge of the signature, said holder and said cutter being movable relatively toward each other for the trimming action, the movement of said cutter and said holder relatively toward each other is rotatable, the signature has four edges with one thereof being folded and with said holder receiving the signature with the other three edges of the signature extending beyond said holder, said holder being a clamp for clamping the signature therein, and said cutter including three cutting edges with respective ones thereof in the plane of the other three edges of the signature, for trimming all three other edges off the signature.

9. The apparatus for trimming a signature as claimed in claim 8, including adjustment members on said holder for positioning the signature therein with a selected amount of the edges extending beyond the holder.

* * * * *